US009151095B2

(12) United States Patent
Syring

(10) Patent No.: US 9,151,095 B2
(45) Date of Patent: Oct. 6, 2015

(54) DEVICE FOR PULLING A DOOR PANEL OR A WINDOW CASEMENT TOWARD THE FRAME

(75) Inventor: Ralf Syring, Edertal-Kleinern (DE)

(73) Assignee: Syring SchlieBsysteme GmbH, Edertal-Kleinern (DE)

( * ) Notice: Subject to any disclaimer, the term of this patent is extended or adjusted under 35 U.S.C. 154(b) by 729 days.

(21) Appl. No.: 13/343,758

(22) Filed: Jan. 5, 2012

(65) Prior Publication Data

US 2012/0167341 A1 Jul. 5, 2012

(30) Foreign Application Priority Data

Jan. 5, 2011 (DE) ..... 10 2011 007 965

(51) Int. Cl.

| | |
|---|---|
| ***E05B 63/20*** | (2006.01) |
| ***E05C 19/02*** | (2006.01) |
| ***E05B 17/00*** | (2006.01) |
| ***E05B 63/18*** | (2006.01) |
| *E05B 15/02* | (2006.01) |

(52) U.S. Cl.

CPC ..... *E05C 19/028* (2013.01); *E05B 17/0025* (2013.01); *E05B 63/18* (2013.01); *E05B 15/024* (2013.01); *Y10T 16/599* (2015.01)

(58) Field of Classification Search

CPC ..... E05C 1/00; E05C 1/004; E05C 1/006; E05C 1/02; E05C 19/02

USPC ..... 292/340, 341, 341.13, 341.15, 305, 292/341.17, 341.18, 341.19, DIG. 4, 292/DIG. 12, DIG. 19, DIG. 26, DIG. 39, 292/DIG. 41, DIG. 55, DIG. 61, 332, 333, 292/335, DIG. 60, DIG. 20, DIG. 47, 341.12, 292/137, 163, 164, 175, 138, 145–147, 150, 292/193; 49/394; 16/82, 83, 85, 71, 72

See application file for complete search history.

(56) References Cited

U.S. PATENT DOCUMENTS 344,722 A * 6/1886 Clark ..... 292/78
445,108 A * 1/1891 Wright ..... 292/78

(Continued)

FOREIGN PATENT DOCUMENTS

DE 10108494 A1 10/2001
FR 2732062 A1 9/1996

OTHER PUBLICATIONS

Search Report issued for co-pending European Patent Application No. 11008567 on May 22, 2015.

*Primary Examiner* — Alyson M Merlino

(74) *Attorney, Agent, or Firm* — Gifford, Krass, Sprinkle, Anderson & Citkowski, P.C.; Douglas L. Wathen

(57) ABSTRACT

Device for pulling a door panel or a window casement toward a frame, comprising a traction device arranged in the rabbet of the door panel or the frame, wherein the traction device can be engaged with a retracting block arranged in the rabbet of the frame or the door panel, wherein the traction device comprises a traction element that is loaded by a spring that can be moved in vertical direction, wherein the retracting block comprises an inclined retracting structure, and wherein the traction device comprises means for engaging the traction element with the inclined retracting structure, wherein tension from the spring when engaging with the inclined retracting structure moves the traction element along the inclined retracting structure.

17 Claims, 6 Drawing Sheets

(56) References Cited

U.S. PATENT DOCUMENTS

| | | | | | |
|---|---|---|---|---|---|
| 731,775 | A | * | 6/1903 | Hall | 70/154 |
| 985,433 | A | * | 2/1911 | Mink | 292/255 |
| 1,298,266 | A | | 3/1919 | Vaudreuil | |
| 1,417,815 | A | | 5/1922 | Fischer | |
| 1,480,181 | A | * | 1/1924 | Mueller | 70/103 |
| 1,491,206 | A | * | 4/1924 | Lewis | 16/85 |
| 1,579,619 | A | * | 4/1926 | Frank | 292/19 |
| 1,804,382 | A | * | 5/1931 | Kashian | 292/173 |
| 2,094,990 | A | * | 10/1937 | Lang | 292/187 |
| 2,174,987 | A | | 10/1939 | Lickteig | |
| 2,581,606 | A | | 1/1952 | Seaman et al. | |
| 2,689,758 | A | * | 9/1954 | Orr | 292/194 |
| 2,893,774 | A | * | 7/1959 | Carpenter | 292/280 |
| 3,102,307 | A | * | 9/1963 | Johnson et al. | 49/394 |
| 3,444,648 | A | * | 5/1969 | Art et al. | 49/248 |
| 3,599,452 | A | * | 8/1971 | Maruyama et al. | 70/200 |
| 4,188,753 | A | * | 2/1980 | Colombo | 49/394 |
| 4,227,723 | A | | 10/1980 | Rosell | |
| 4,620,393 | A | * | 11/1986 | Stafset | 49/394 |
| 4,676,537 | A | * | 6/1987 | Esser | 292/341.15 |
| 4,803,808 | A | * | 2/1989 | Greisner | 49/394 |
| 4,807,914 | A | * | 2/1989 | Fleming et al. | 292/48 |
| 4,960,297 | A | * | 10/1990 | Bouse et al. | 292/223 |
| 5,058,938 | A | * | 10/1991 | Doring et al. | 292/45 |
| 5,373,716 | A | * | 12/1994 | MacNeil et al. | 70/109 |
| 5,941,106 | A | | 8/1999 | Williamson, Jr. et al. | |
| 7,090,263 | B2 | * | 8/2006 | Quigley et al. | 292/302 |
| 7,219,469 | B2 | * | 5/2007 | DiFrancesco | 49/395 |

* cited by examiner

DEVICE FOR PULLING A DOOR PANEL OR A WINDOW CASEMENT TOWARD THE FRAME

FIELD OF THE INVENTION

The invention concerns a device for pulling a door panel or a window casement toward the frame, which device is not visible when the door is closed, and said device comprises a traction device arranged in the rabbet of the door panel or frame, wherein it is possible to engage the traction device with a retracting block arranged in the rabbet of the frame or door panel. Consequently, when the traction device is arranged in the rabbet of the door panel, the retracting block is situated in the rabbet of the frame and vice versa.

BACKGROUND OF THE INVENTION

The U.S. Pat. No. 1,417,815 A discloses an arrangement by means of which a door can be brought in closed position. For this purpose, visible to the outside, a spring-loaded pin with a roll on one end is provided at the door panel, and the spring-loaded pin has a corresponding bracket on the door frame. The bracket has an intake structure which is inclined toward the frame, and the roll of the spring-loaded pin moves on the intake structure. As a result of the spring force of the pin, the door panel is pulled to the frame. The device is very bulky, and for optical reasons alone, it cannot be used for customary front doors or room doors, and certainly not for windows. Moreover, it involves the danger that fingers and pieces of clothing, for example scarfs, ties, etc., are being caught between the door and frame because the locking mechanism becomes effective even before the door comes to rest on the frame.

A device for pulling a door or window to a blind frame has been disclosed in the DE 101 08 494 C2. In particular, this device comprises a snap-action device having a traction bolt, as well as a closing hook, wherein the closing hook can be engaged with the traction bolt, wherein the traction bolt or the closing hook are mounted at the door or the blind frame. The closing hook mounted at the door is moved in the direction of the snap-in device which comprises the traction bolt and a spring. At the moment when the hook finger reaches an inclined intake structure, the hook finger is moved upward against spring force. In the process, the hook finger passes an engaging piece at the extraction bolt. Then the hook finger moves downward into an undercut so that the closing hook engages with the extraction bolt. When the door continues to move toward the strike plate, the inclined intake structure of the closing hook reaches the area of the pivoting bolt. In the process, the bolt disengages from the extraction bolt. Since now the extraction bolt is no longer blocked by the pivoting bolt, the extraction bolt is moved by the force of two springs in the direction of the blind frame and takes along the closing hook and, consequently, the door so that the door is pulled toward the blind frame.

The device functions in a very satisfactory manner. However, because of its complicated mechanism, it is expensive to produce

BRIEF DESCRIPTION OF THE INVENTION

The invention has the objective of providing a device for pulling a door panel or a window casement toward the respective frame which requires considerably fewer components, is easy to assemble and inexpensive to produce.

To achieve this objective for a device of the type mentioned above in which the traction device can be engaged with the retracting block, it is proposed that the traction device comprises a spring-loaded traction element that can be moved in vertical direction, wherein the retracting block comprises an inclined retracting structure, and wherein the traction device comprises means for engaging the traction element with the inclined retracting structure, wherein because of the tension when engaging with the inclined retracting structure the traction element moves along the inclined retracting structure. This results in the following facts:

The traction device is situated in the rabbet of the door panel and is not visible when the door, for example, is closed. Correspondingly, the retracting block is situated in the frame of the door or the window, namely in such a way that traction device and retracting block are positioned opposite from each other when the door or the window is closed. This means that the door panel or the window casement is pulled toward the frame only when the door panel is basically in closed position at the frame. The arrangement can also be reversed, i.e., the retracting block is situated at the door panel and the traction device at the frame. As described above, the traction device comprises a traction element which can be moved in vertical direction because of the fact that it is spring-loaded. The retracting block has an inclined retracting structure, as well as means for engaging the traction element with the inclined retracting structure. When the traction element is engaged with the inclined retracting structure, the tension causes the traction element to move along the inclined retracting structure. As a result, the door panel is pulled toward the door frame or the window casement is pulled toward the casement frame. This means that the inclined retracting structure is arranged at the retracting block diagonally in a longitudinal direction, or along the height of the door.

The sub claims disclose further advantageous embodiments and characteristics of the invention.

According to a first embodiment, it has been arranged that the means with which the traction element can be engaged with the inclined retracting structure comprises a release member that is held in preloaded position by means of a spring and that releases the traction element when the door panel, for example, is in closed position. When the door panel is in opened position, as a result of the spring force the release member keeps the traction element in a position in which it can be engaged with the inclined retracting structure. In particular, with regard to this embodiment, provision has been made that the traction element comprises a traction bolt that can be engaged with the inclined retracting structure. The traction bolt in the form of a pin slides along the inclined retracting structure and ensures that the door panel is pulled toward the door frame. To activate the release member for releasing the traction element from its preloaded position, the release member is provided with a sliding bolt which can be brought in contact with the retracting block when the door is closed. In the process, the release member is horizontally moved away from the area of the traction element, resulting in the fact that, when the traction bolt is situated in the area of the inclined retracting structure and because of the tension exerted on the traction element and the traction bolt, the door panel is pulled toward the door frame.

For guiding the sliding bolt, the retracting block has a respective recess, wherein the length of the recess is selected in such a way that the traction element is released when the traction bolt of the traction element is situated in the area of the inclined retracting structure.

The release member is under the tension of at least one spring acting in horizontal direction when mounted. When the door is opened, i.e., when the traction bolt is moved out of the inclined retracting structure and thus through the traction element, the spring ensures that the spring acting on the traction element is loaded and moves back into the starting position in which the release member holds the traction element in tension when the door is open.

According to a second embodiment, it has been arranged that the retracting block comprises an inclined intake structure aligned in longitudinal direction so that the traction element can be engaged with the inclined retracting structure. For this purpose, the inclined retracting structure and the inclined intake structure culminate in an apex with the inclined intake structure and the inclined retracting structure forming a triangle. This results in the following facts:

Upon closing the door, the traction bolt slides along the inclined intake structure to the apex of the inclined intake structure which forms the transition to the inclined retracting structure. When the traction bolt reaches the apex formed by the inclined intake structure and the inclined retracting structure, upon further closing motion of the door panel it reaches the area of the inclined retracting structure, wherein because of the spring force acting on the traction element the door panel is pulled toward the door frame in the way described above. As an alternative to the arrangement of the release member, this inclined intake structure can be provided as part of the traction device or as an additional part. In any case, the inclined intake structure also makes sure that during the closing process the traction bolt can be engaged with the inclined retracting structure by way of the inclined intake structure when, for example, children have moved the release member into a position in which the traction element has been released.

Advantageously, provision has also been made that the tension of the spring to which the traction element is subjected can be adjusted. For this purpose, an adjusting screw has been provided and the adjusting screw is mounted inside the device in a jack provided with a thread. By turning the adjusting screw, it is possible to adjust the pretension of the spring. To be able to adjust the screw, a recess is located in the area of the screw head in the cover plate receiving the device or in the rabbet of the door or window casement. The screw head of the adjusting screw can be turned, for example, by means of an Allen wrench. In the cover plate, the recess is closed to the outside by means of a cap.

As an alternative, the release member is designed as a swivel-mounted lever which can be pivoted in spring-loaded manner into a position such as the one shown in FIG. 7. As shown in FIG. 7, the spring is designed as a leg spring and ensures that the traction element is held in preloaded position.

For the device to function in a satisfactory manner, it is required that the retracting block and the traction device occupy a particular position relative to one another in the rabbet of the door panel or the blind frame. Depending on the mounting situation, it can be required that the retracting block and the traction device have to be adjusted in their position relative to one another.

For this purpose, according to a characteristic of the invention, provision has been made that the retracting block in the area of the inclined retracting structure comprises an insert which has a sliding piece with at least one inclined retracting structure, wherein the insert can be fixed in changeable manner in its position in relation to the retracting block. In this way, the position of the inclined intake structure or inclined retracting structure in relation to the traction element of the traction device can be adjusted, namely for the purpose of a height adjustment when the door panel is assembled. In particular, it has been provided in this context that the position of the insert can be fixed in changeable manner by means of an arrester. This means that the insert can be fixed at specific predetermined spaces in relation to the retracting block.

In particular, the retracting block comprises a base on which the position of the insert can be fixed in changeable manner. For this purpose, the base is provided with locking members that interact with respective locking notches in the insert.

A different embodiment is characterized by the fact that the retracting block can be fixed on a base track in such a way that it can be moved in longitudinal direction to the base track. Instead of the previously described insert in which the position of the inclined retracting structure and the inclined intake structure in relation to the retracting block can be changed in longitudinal direction of the rabbet, the fact that the retracting block can be moved in relation to the base track makes it possible to adjust the position of the entire retracting block in relation to the traction element. Such an option is always of interest when, for example, the recess for receiving the sliding bolt in the retracting block is not aligned with the sliding bolt and when it is perhaps not possible to engage the traction element with the inclined intake structure. In these cases the possibility for changing the position of the retracting block on the base track in longitudinal direction of the rabbet has proved to be of advantage.

To be able to move the retracting block on the base track, an adjusting device has been provided, for example, in the form of a screw, which is mounted in a respective support bracket with an inside thread arranged on the base track. One end of the screw is connected with the retracting block in such a way that the retracting block can be moved along the base track when the screw is adjusted.

To be able to fix the retracting block on the base track, lateral guiding elements are provided which engage in the upper surface of the retracting block.

Subsequently, the invention is described in an exemplary manner by means of the drawings.

DETAILED DESCRIPTION OF THE INVENTION

Figure 1:
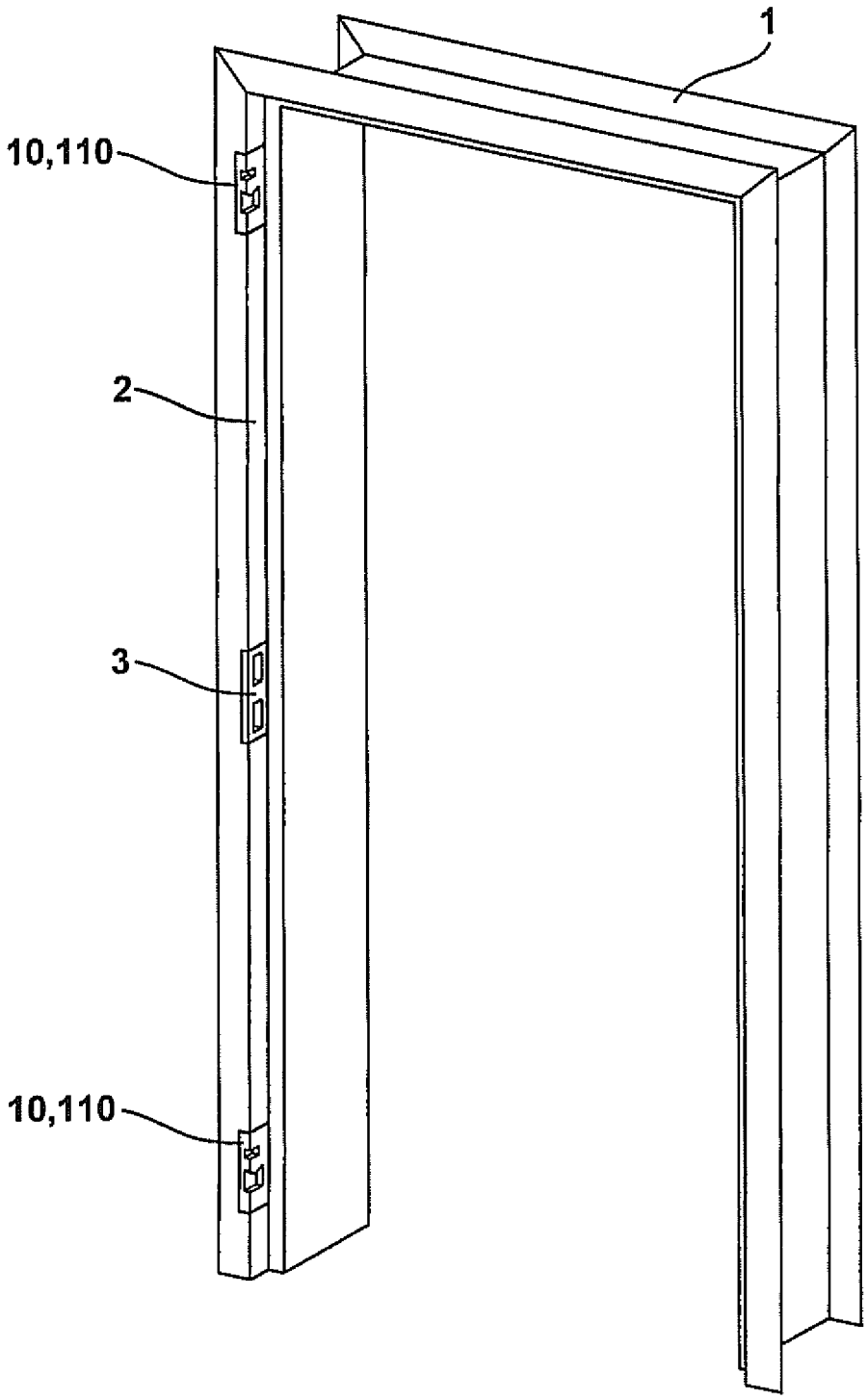
FIG. 1 shows a perspective view of the door frame in which the retracting block is arranged on both sides of the door lock.

According to FIG. 1, the door frame is depicted with the numeral 1. The door frame has a rabbet 2, wherein the door lock 3 is located inside the rabbet and in assembled state a respective retracting block 10 is mounted on both sides of the door lock on the top and bottom of the door.

Figure 2:
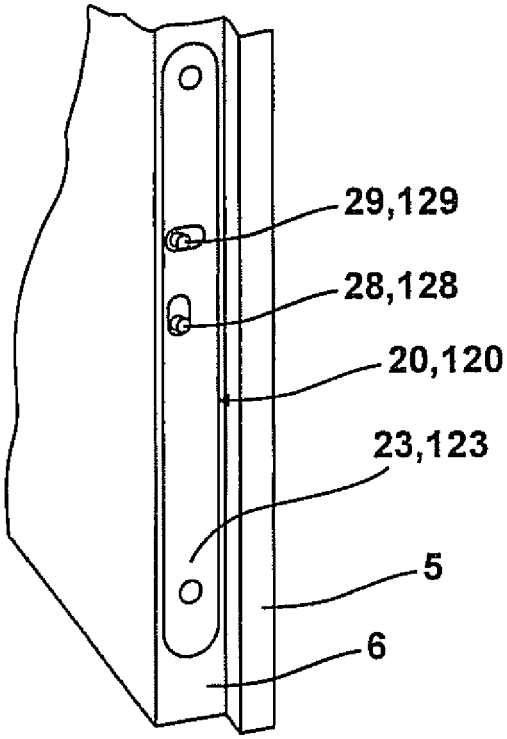
FIG. 2 shows a perspective view of the lower area of the rabbet of a door panel, wherein the traction device is provided (covered by the cover plate)

FIG. 2 shows the door panel 5 with the rabbet 6, wherein covered by the cover plate 23, 123 the traction device 20, 120 is located in the area of the rabbet 6. The arrangement of the traction device 20, 120 in the rabbet 6 of the door panel corresponds with the arrangement of the respective retracting blocks 10, 110 in the rabbet 2 of the door frame. This means that when the door is closed the retracting block 10, 110 and the traction device 20, 120 are positioned directly opposite of one another.

Figure 3:
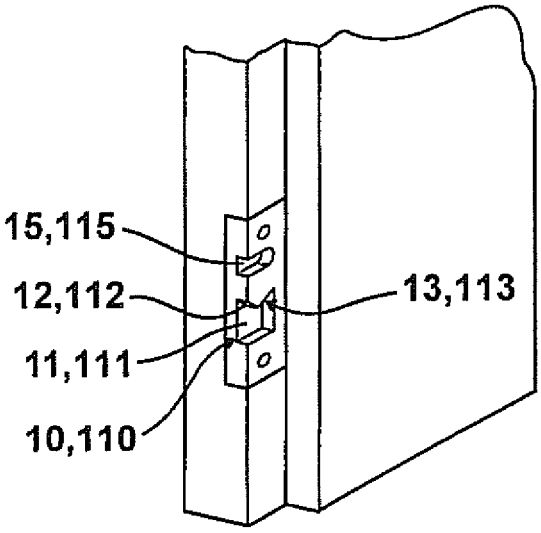
FIG. 3 shows an enlarged perspective view of a retracting block of the type shown in FIG. 1.

FIG. 3 shows the particular design of the retracting block 10, 110. The retracting block 10, 110 comprises a recess 11, 111, wherein in the upper area of the recess the retracting block 10, 110 is shown designed with an inclined intake structure 12, 112 and the inclined retracting structure 13, 113. Above the inclined retracting structure 13, 113 or the inclined intake structure the recess 15, 115 is located in the retracting block 10, 110.

Figure 4:
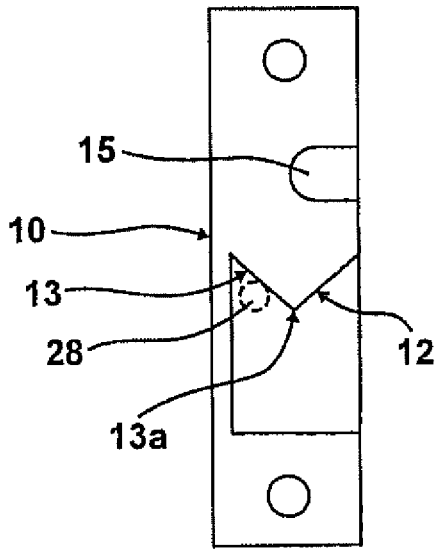
FIG. 4 shows the left side of the retracting block.
Figure 5:
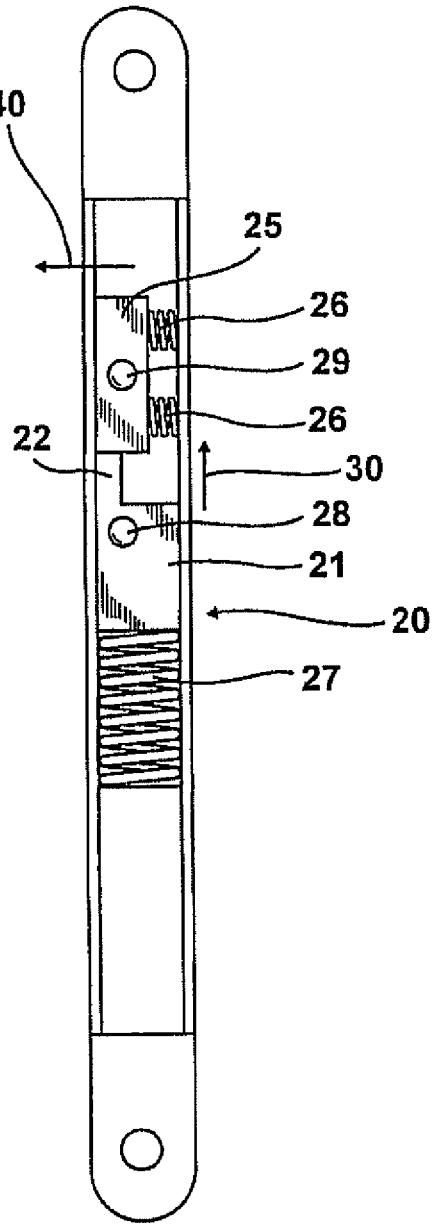
FIG. 5 shows on the right side the traction device.

When FIGS. 4 and 5 are compared with a first embodiment, the following facts are demonstrated with regard to the traction device 20, which is shown without cover:

The traction device 20 receives in relocatable manner the traction element 21 in the direction of the arrow 30, i.e., in longitudinal direction of the door. The traction element 21 comprises a finger 22 which is in contact with the release member with the numeral 25. The release member 25 is subject to the load of the springs 26 acting in horizontal direction, which springs press the release member in the direction of the arrow 40. The traction element 21 is also subject to the load of a spring, namely the load of the spring 27 which ensures that the traction element 21 moves in the direction of the arrow 30. In addition, the traction element 21 comprises the traction bolt 28 which is designed in the form of a pin and which protrudes from the drawing plane according to FIGS. 4 and 5. The release member 25 comprises the sliding bolt 29 which is also designed in the form of a pin and protrudes from the drawing plane.

The operating mode of the device for pulling a door panel toward a frame or in the same way for pulling a window casement to a casement frame can be described as follows:

In FIG. 5, the traction device 20 is shown in preloaded position. This means that the release member 25 holds the traction element 21 in tension. When now the traction device 20 is aligned with the retracting block 10, the sliding bolt 29 of the release member 25 reaches the area of the recess 15 of the retracting block 10. The length of the recess 15 is selected in such a way that the release member 25 releases the traction element 21 when the traction bolt 28 is located behind the transition point of inclined intake structure 12 and inclined retracting structure 13. As a result, the traction element 21 is caused by the spring 27 to move in the direction of the arrow 30 and, consequently, the traction bolt 28 slides along the inclined retracting structure 13. The traction bolt 28 is shown on the inclined retracting structure 13 by a dotted line. When the traction bolt 28 has reached the apex of the inclined retracting structure 13 (as shown in FIGS. 4 and 5), the door panel 5 has been pulled completely toward the door frame 1.

When the door is opened, the traction bolt 28 is guided in the opposite direction along the inclined retracting structure 13 (in FIGS. 4 and 5) downward in the direction of the transition point and over the apex 13*a* toward the inclined intake structure 12. In the process, the sliding bolt loses contact with the recess 15, which means that the release member 25 is returned to the position shown in FIG. 5. This means that the traction element 21 is again preloaded by the spring 27 to ensure that by means of the traction bolt 28 the door panel is pulled toward the door frame when the door is closed again.

If now in opened position of the door panel the release member 25 is manually displaced in the opposite direction of the arrow 40, the traction element 21 is displaced in the direction of the arrow 30. Nonetheless, when the door is closed the traction bolt 28 slides along the inclined intake structure 12, preloading the spring 27 of the traction element 21, and passing the apex 13*a*, in order to reach again the area of the inclined retracting structure 13. This clearly shows that the device cannot be manipulated. In particular, an invention-based device for pulling the door panel or window casement toward the respective frame has the advantage that only a few parts protrude over the rabbet of the door frame. FIG. 2 clearly shows that only the sliding bolt 29 and the traction bolt 28 are protruding. Basically, the invention-based device does not interfere with the appearance of the door.

Figure 6:
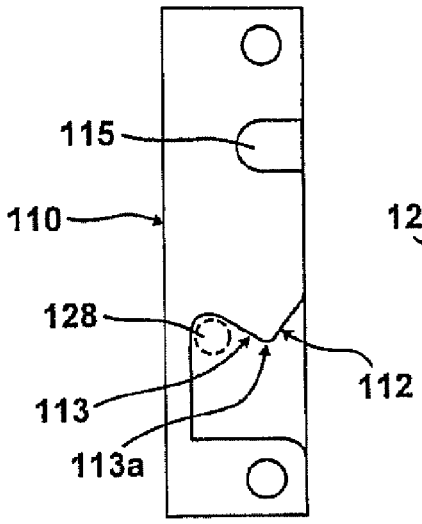
FIG. 6 shows a modified embodiment of the retracting block of FIG. 4.
Figure 7:
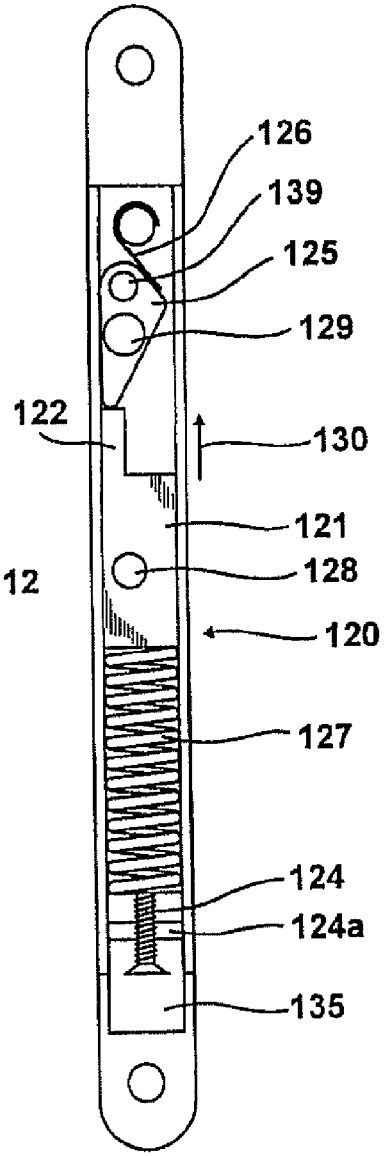
FIG. 7 shows a modified embodiment of the traction device shown in FIG. 5.
Figure 8:
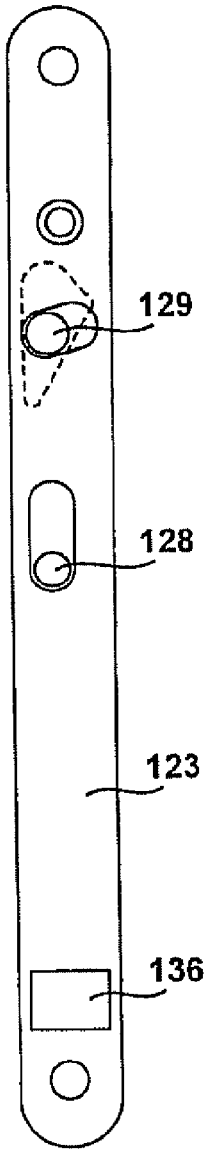
FIG. 8 shows a representation according to FIG. 5 in which the traction device is covered by a respective cover plate.

The function of the embodiment shown in FIGS. 6, 7 and 8 does not differ from the function of the embodiment shown in FIGS. 4 and 5. Only the design of individual components and the possibility of adjusting the tension of the spring 127 of the traction element are different. The reference numerals differ from the ones used in FIGS. 4 and 5. Having said this, the representation according to FIGS. 6 and 7 shows also a retracting block 110 having a recess 115 for the sliding bolt 129 when these are moved toward each other (arrow 40). Below the recess 115, the inclined intake structure 112 and the inclined retracting structure 113 located which form an apex 113*a* at an angle of approximately 90°. The inclined retracting structure 113 interacts with the pin-shaped traction bolt 128 and has the purpose of pulling the door panel toward the blind frame. The traction bolt 128 is a component of the traction element 121 of the traction device 120, wherein the traction element 121 is tensioned by the spring 127. Furthermore, the device involves a jack 124*a* with an adjusting screw 124 by means of which the pretension of the spring 127 can be changed. To be able to turn the adjusting screw 124, a recess 135 has been provided in the area of the head of the adjusting screw, which recess can be closed by a cap 136 located on the cover plate 123 (shown in FIG. 8). In the representation according to FIG. 7, the sliding bolt 129 is located at an approximately triangular release member 125 which is designed as a lever and which can be swiveled about a pivot pin 139, wherein one side of the release member 125 is tensioned by a leg spring 126 in such a way that the release member 125 designed as a pivotable lever always tries to switch into the position shown in FIG. 7 in which the traction element 121 is blocked. By means of the finger 122 the traction element 121 is connected with the release member 125. To release the traction element 121, the release member 125 turns when entering the recess 115 against the force of the leg spring 126 in the direction of the arrow 130. As described above with regard to FIG. 5, the traction element now shifts in the direction of the arrow 30.

Figure 9:
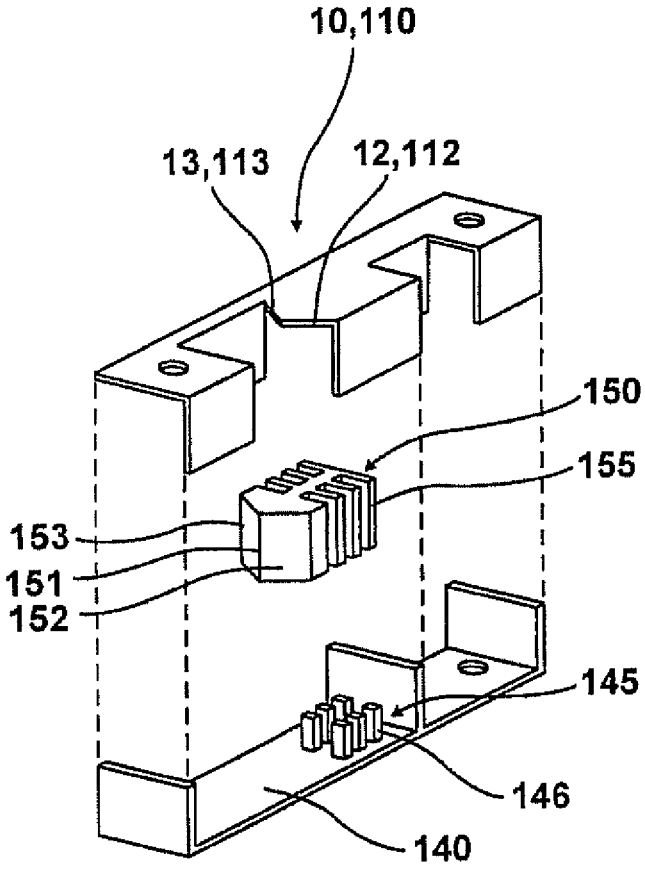
FIG. 9 shows a diagram of the retracting block with a base, wherein the retracting block receives a detachable insert.
Figure 10A:
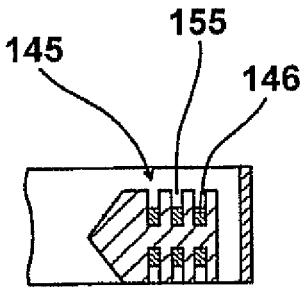
FIG. 10*a*, 10*b* show the adjustment of the insert on the base.
Figure 10B:
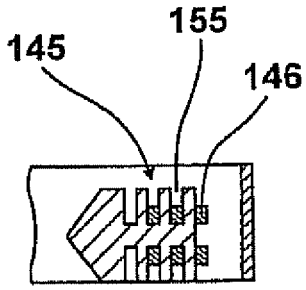

The retracting block 110 shown in FIG. 9 is provided with a base 140. In the area of the inclined retracting structure 113 and the inclined intake structure 112, an insert has been provided between the base 140 and the retracting block 110. The insert 150 has a sliding piece 151 which is provided with an inclined intake structure 152 and an inclined retracting structure 153 which run parallel to the inclined retracting structure 113 or the inclined intake structure 112. By means of an arrester 145, the insert 150 can be fixed at the base 140. The arrester 145 comprises locking notches 155 arranged in the insert 150 which interact with locking members 146 respectively arranged in the base 140. FIGS. 10*a* and 10*b* show how they can be adjusted.

Figure 11A:
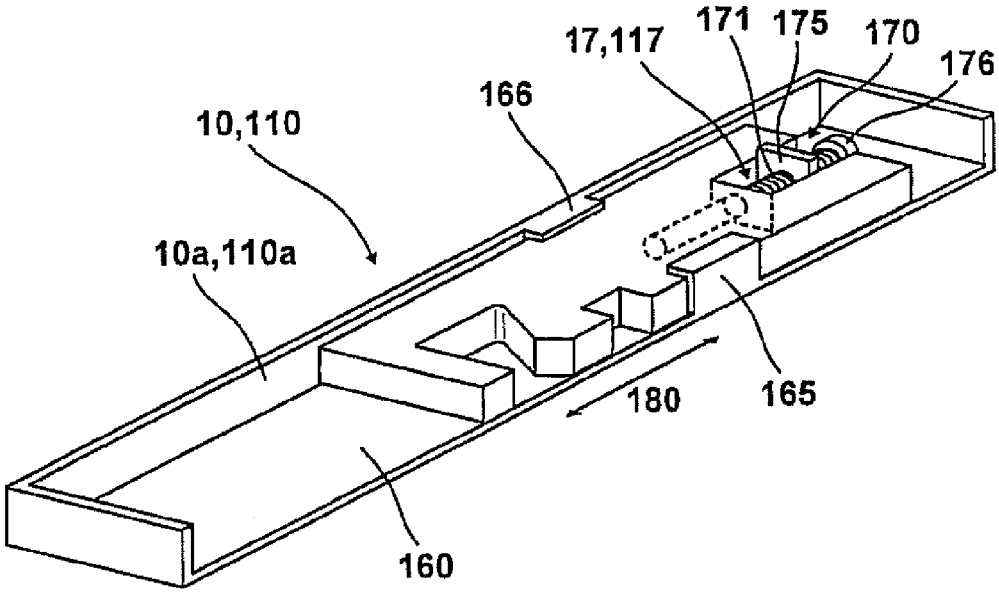
FIG. 11*a* shows the possibility of adjusting the retracting block on a base track.
Figure 11B:
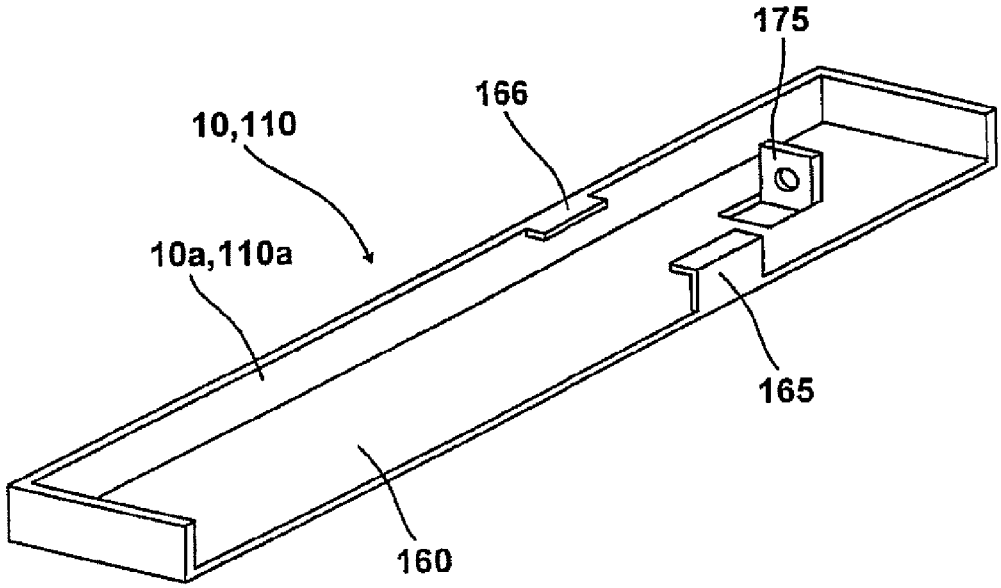
FIG. 11*b* shows the base track.

The representation according to FIGS. 11*a* and 11*b* is characterized by the fact that the retracting block 10 is mounted in such a way that it can be moved on a base track 160 along the arrow 180. This means that the base track 160 has a longitudinal extension that is greater than the longitudinal extension of the retracting block 10. To be able to adjust the retracting block 10 on the base track 160, an adjusting device 170 has been provided. The adjusting device 170 comprises a support bracket 175 with a thread 171 for receiving a screw 176 and one end of the screw is connected with the retracting block 10. The support bracket 175 is mounted in a groove-shaped recess 17, 117 so that by means of the support bracket 175 the retracting block 10 can be guided laterally. Furthermore, the retracting block 10 is guided on the base track 160 in that the base track comprises guiding elements 165, 166, wherein the guiding elements 165, 166 engage in the upper surface 10*a*, 110*a* of the retracting block 10 (shown in FIG. 11*a*). It proves to be beneficial when the retracting block 10, 110 can be adjusted on the base rack by approximately +/−7 mm.

It should also be mentioned that it is not necessary to provide a lock at the center of the door when three of the invention-based devices are distributed long the length or height of the door.

REFERENCE LIST

1 door frame
2 rabbet
3 door lock
5 door panel
6 rabbet
10 traction block
10*a* surface of the locking mechanism
11 recess
12 inclined intake structure
13 inclined retracting structure
13*a* apex
15 recess for sliding bolt
17 groove-shaped recess in retracting block
20 traction device
21 traction element
22 rabbet joint
23 cover plate
25 release member
26 spring
27 spring
28 traction bolt
29 sliding bolt
30 arrow
40 arrow
110 retracting block
111 recess in retracting block
112 inclined intake structure
113 inclined retracting structure
113*a* apex
115 recess for the sliding bolt
120 traction device
121 traction element
122 rabbet joint
123 cover plate
124 adjusting screw
124*a* jack
125 release member
126 leg spring
127 spring
128 traction bolt
129 sliding bolt
130 arrow
135 recess
136 cap
139 pivot pin
140 base
145 arrester
146 locking members
150 insert
151 sliding piece
152 inclined intake structure
153 inclined retracting structure
155 locking notches
160 base track
165 guiding element
166 guiding element
170 adjusting device
171 thread
175 support bracket
176 screw
180 arrow

The invention claimed is:

1. A device for pulling a door panel or a window casement toward a frame, comprising:

a traction device arranged in a rabbet of the door panel or the window casement or a rabbet of the frame;

a retracting block arranged in the other of the rabbet of the frame or the rabbet of the door panel or window casement;

the traction device and the retracting block being arranged such that the traction device engages the retracting block when the door panel or window casement mates with the frame;

the retracting block having a stationary inclined retracting structure, the inclined retracting structure being angled with respect to a vertical axis;

the traction device including a traction element linearly movable along the vertical axis and a spring disposed so as to load the traction element, wherein the traction element includes a traction bolt protruding from and fixed relative to the traction element so as to directly engage with the inclined retracting structure when the door panel or window casement mates with the frame, the traction device further having a release member for retaining and releasing the traction element to move along the vertical axis;

wherein when the traction device engages the retracting block, the release member releases the traction element such that the traction bolt directly engages the inclined retracting structure and the spring urges the traction bolt to move along the inclined retracting structure, thereby pulling the door panel or window casement towards the frame.

2. The device according to claim 1, wherein the inclined retracting structure is adjustable between a plurality of stationary positions.

3. The device according to claim 1, wherein the release member which is held in a preloaded position by means of a spring.

4. The device according to claim 3, wherein the release member is subject to the load of at least one spring acting in a horizontal direction.

5. The device according to claim 1, wherein the traction bolt is designed in the form of a pin.

6. The device according to claim 1, wherein the release member comprises a sliding bolt configured to be brought in contact with the retracting block.

7. The device according to claim 6, wherein the retracting block comprises a respective recess for guiding the sliding bolt.

8. The device according to claim 5, wherein the length of the recess has been selected so that the traction element is released when the traction bolt of the traction element is located in the area of the inclined retracting structure.

9. The device according to claim 1, wherein the retracting block comprises an inclined intake structure arranged in a longitudinal direction of the door or window casement and operable for transferring the traction bolt into the position where it engages with the inclined retracting structure.

10. The device according to claim 1, wherein the tension of the spring can be adjusted.

11. The device according to claim 1, wherein the retracting block comprises an insert proximate the inclined retracting structure, wherein the insert has a sliding piece having at least one inclined retracting structure, and wherein a position of the insert can be fixed in a changeable manner in relation to the retracting block.

12. The device according to claim 11, wherein the insert can be fixed in a changeable manner in its position by means of an arrester.

13. The device according to claim 1, wherein the arrester on the base comprises locking member which interact with respective locking notches in the insert.

14. The device according to claim 11, wherein the retracting block comprises a base on which the insert can be fixed in a changeable manner in its position.

15. The device according to claim 1, wherein the retracting block is fixed on a base track so that is can be moved in a longitudinal direction to the base track between a plurality of stationary positions.

16. The device according to claim 15, including an adjusting device disposed on the base track for moving the retracting block.

17. The device according to claim 15, wherein the retracting block is mounted so that it can be guided through the base track.

* * * * *